US007482522B2

(12) United States Patent
Wening

(10) Patent No.: US 7,482,522 B2
(45) Date of Patent: Jan. 27, 2009

(54) CAJON INCORPORATING A SNARE CARPET

(75) Inventor: Reinhard Wening, Dietenhofen (DE)

(73) Assignee: Roland Meinl Musikinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/703,707

(22) Filed: Feb. 8, 2007

(65) Prior Publication Data

US 2008/0110321 A1 May 15, 2008

(30) Foreign Application Priority Data

Nov. 11, 2006 (DE) ..... 10 2006 053 240

(51) Int. Cl.
*G10D 13/02* (2006.01)

(52) U.S. Cl. ..... 84/415; 84/411 R

(58) Field of Classification Search ..... 84/415
See application file for complete search history.

(56) References Cited

U.S. PATENT DOCUMENTS

| | | | | |
|---|---|---|---|---|
| 478,611 | A * | 7/1892 | Knittel | 84/416 |
| 1,265,917 | A * | 5/1918 | Jay | 84/415 |
| 1,291,903 | A * | 1/1919 | Isham | 84/269 |
| 1,722,032 | A * | 7/1929 | Bower | 84/415 |
| 6,177,620 | B1 * | 1/2001 | Alulyan | 84/415 |
| 2008/0034944 | A1 * | 2/2008 | Aspland | 84/415 |
| 2008/0083317 | A1 * | 4/2008 | Payerl | 84/411 R |
| 2008/0110321 | A1 * | 5/2008 | Wening | 84/421 |

FOREIGN PATENT DOCUMENTS

| | | | |
|---|---|---|---|
| AT | DE 202005000987 U 1 | * | 9/2005 |
| AT | DE 202006015511 U 1 | * | 9/2005 |
| AT | DE 202006015511 U 1 | * | 11/2006 |
| EP | 1751739 A1 | * | 2/2007 |
| WO | WO 2005116987 A 1 | * | 12/2005 |

OTHER PUBLICATIONS

Big Cajones © 2006, testing Apr. 9, 2006, maxkelly. com/features/music/insrument_cajon.html, viewed Mar. 13, 2008.*
History of the Cajon, www.cajondg.com/en/products/history.html, viewed Mar. 13, 2008.*
The Kotz ToneCajon, reprint from the Latin Beat Magazine, Nov. 2001, www.tonecajon.com/index.php?page=pressDet&file_id=39, viewed Mar. 13, 2008.*
A Self-Built Set of Chajnes for Cuban Yambu, Thomas Altmann, 2006, www.ochemusic.de/artcajon.htm, viewed Mar. 13, 2008.*

(Continued)

*Primary Examiner*—Walter Benson
*Assistant Examiner*—Robert W Horn
(74) *Attorney, Agent, or Firm*—Browdy and Neimark, P.L.L.C.

(57) ABSTRACT

In a cajon incorporating a snare carpet that rests against the reverse of a front plate, provision is made that the snare carpet is supported pivotable and actuatable by means of a pedal.

11 Claims, 2 Drawing Sheets

OTHER PUBLICATIONS

The Flamencophile Chronicles, Feb. 28, 2007, origins of the cajon in flamenco music, http://philamenco.blogspot.com/2007/02/in-2003-i-had-pleasure-of-attending.html, viewed Mar. 13, 2008.*

Meinl Percussion, Snare Cajons, http://meinlpercussion.com/products/meinl_percussion/cajons/snare_cajons.html, viewed Mar. 13, 2008.*

Meinl Percussion, Passion for details, http://meinlpercussion.com/community/cajon/cajon_facts/passion_for_details.html, viewed Mar. 14, 2008, a disclosure of the patented subject matter, foot pedal, snares, etc.*

How to Build Flamenco Cajon with Plywood, German Ocana © 2004, http://www.davidbruce.net/building_cajon.pdf, viewed Mar. 13, 2008.*

Salwender International, Cajones, © 2006, http://www.salwender.com/Cajon.htm, viewed Mar. 13, 2008.*

* cited by examiner

CAJON INCORPORATING A SNARE CARPET

BACKGROUND OF THE INVENTION

Field of the Invention

The invention relates to a cajon incorporating a snare carpet that rests against the reverse of a front plate. The cajon is played with the player sitting on the top surface of the cajon and striking the outside of the front plate, which is thereby set into vibration. A snare carpet that rests against the inside of the front plate is also set into vibration by the vibrations of the front plate and produces a characteristic snare sound.

SUMMARY OF THE INVENTION

With this as the starting point, the invention has as its object to further improve such a cajon in such a way that the sound of the musical instrument can be adjusted by the player during playing.

This object is met in such a way that the snare carpet is disposed pivotable, provision being made in particular for the pivot movement of the snare carpet to be actuatable by means of a pedal.

Correspondingly, the player is able, without interruption or impairment of the playing, by actuation of the pedal, to change the tone color of the instrument, i.e., to activate or deactivate the influence of the sound carpet.

To this end, provision may furthermore be made for the snare carpet to be pivotable between a position resting against the inside of the front plate and a pivoted-back position, wherein in the pivoted-back position it rests against a damper strip, which extends parallel to the front plate at a distance from the same substantially vertically. This accomplishes that not only is the snare carpet not excited by the front plate, but vibrations of the housing are damped in general.

The pedal is preferably supported pivotable in a side wall of the housing.

To provide for the transfer of the pivot movement of the foot pedal into a pivot movement of the snare carpet, various mechanisms are possible. One advantageous transfer mechanism provides that the pivot movement of the pedal is transferred via a pivot pin that is supported in a bearing, a lever projection fastened thereto, and via a pivot hinge onto an actuation rod, and from there via a pivot hinge onto an additional lever projection of a pivot arm, which, in turn, supports the snare carpet.

To attain a defined, faultless guiding, the distal end of the lever projection may be provided with a pin, which engages into a guide groove in the side wall.

The guide groove may be formed in a metal plate that is mounted to the side wall.

The invention will be explained in more detail below based on a preferred example embodiment in conjunction with the drawing:

DESCRIPTION OF THE PREFERRED EMBODIMENT

Figure 1:
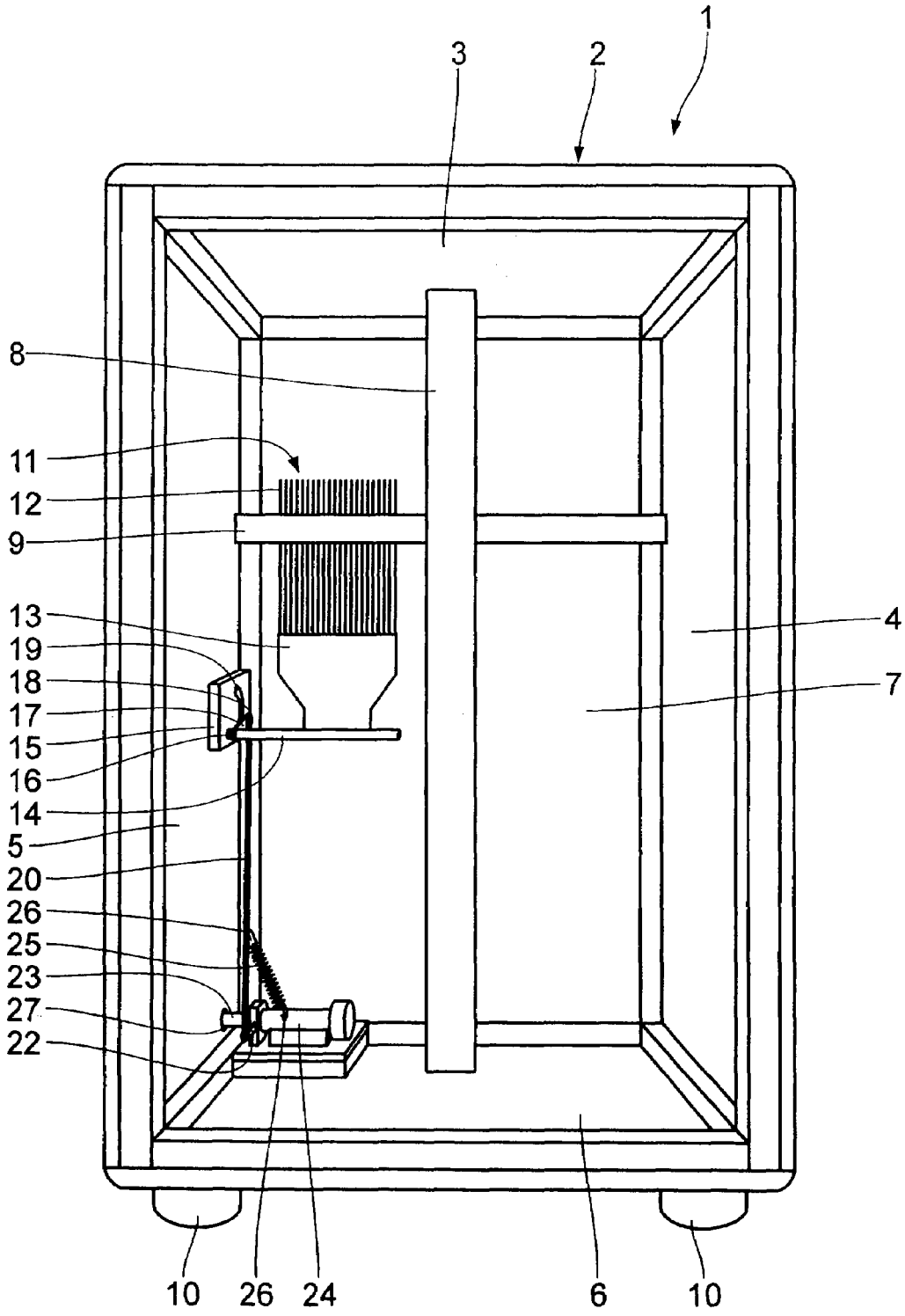
FIG. 1 shows a perspective view of the cajon from the rear without back plate.
Figure 2:
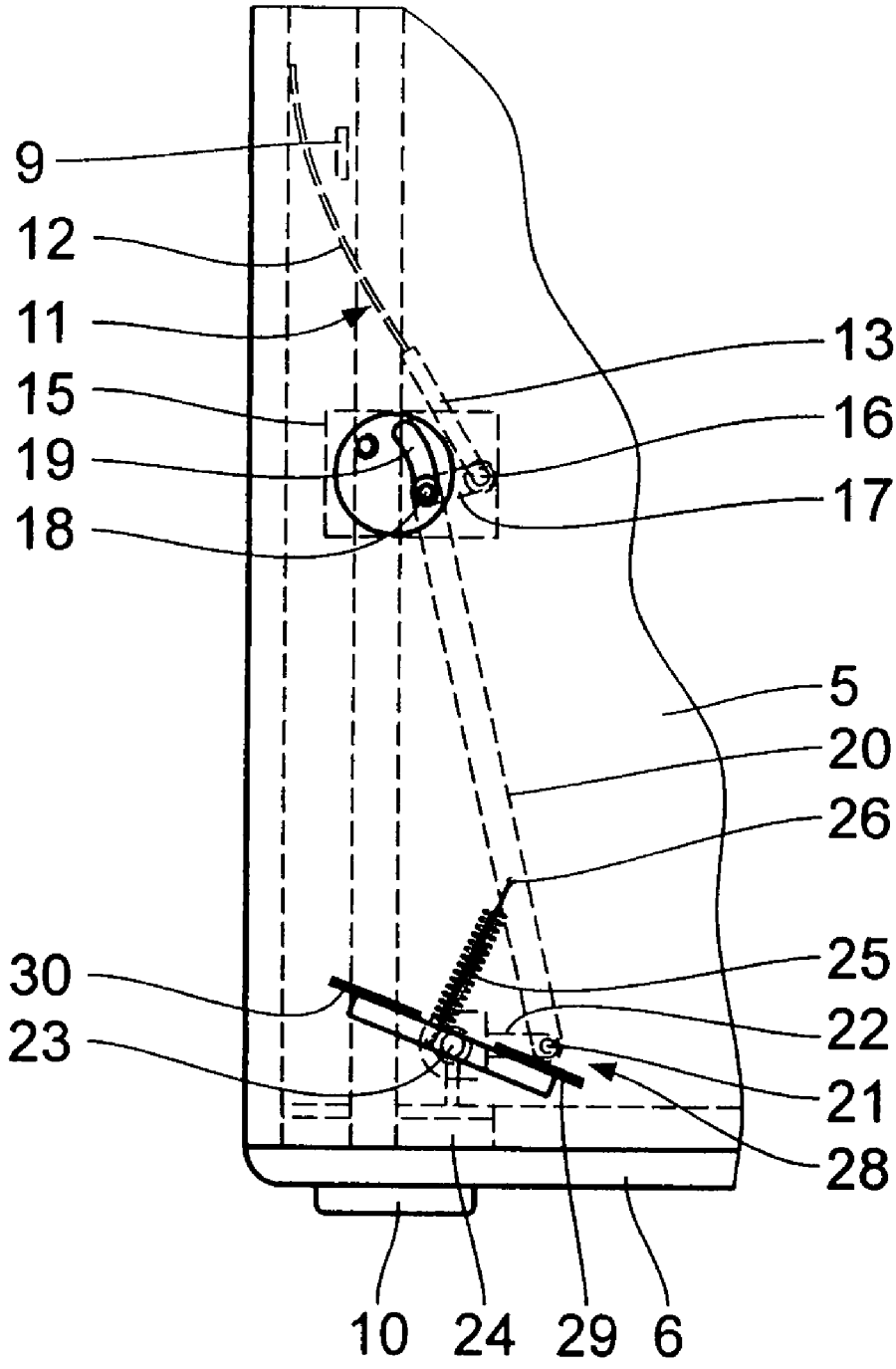
FIG. 2 shows a side view to illustrate the actuation mechanism.

A cajon 1 shown in the drawing comprises a block-shaped wooden housing 2 having a cover plate 3, two side plates 4, 5, a bottom plate 6, and a front plate 7 on which it is played, as well as a back plate not shown in the drawing that has a sound opening. Extending in the region behind the front plate 7 is a vertical brace 8. Extending crosswise to the same is a horizontal damper strip 9. Located underneath the base plate 6 are feet 10.

A so-called snare carpet 11 consisting of a plurality of wire elements 12 extending parallel to one another, and a support plate 13, which is disposed on a pivot arm 14 that is pivot-mounted on a metal plate 15 on the inside of the side wall 5 at 16. Provided at the inner end, i.e., in the region of the pivot bearing 16, extending away from the pivot arm 14 is a lever projection 17, at the distal end of which a bolt 18 is provided, which engages into a circular-segment shaped link guide 19 in the metal plate 15. The pin 18 is hinged to an actuation arm 20 that extends in the direction toward the bottom plate 6 and which, in turn, is connected via a hinge 21 to a lever 22, said lever 22, in turn, being rigidly connected to a pivot pin 23 that is disposed in a bearing 24, which is supported on the bottom plate 6.

A helical spring 25 extends between a fastening region 26 on the actuation arm 20 and a fastening region 26 on the bearing 24.

The pivot pin 23 that is supported in the bearing 24 extends through an opening 27 of the side wall 5 to the outside, where a pedal 28 is affixed that has two treads 29, 30.

From the above-described mechanism it becomes apparent that by actuation of the frontal tread 30 of the pedal 28 and downward pivoting of the same, the snare carpet 11 is pivoted away from the front plate 7, namely away from the striking surface toward the rear, i.e., in FIG. 1 toward the observer, until it comes to rest against the damper strip 9. The sound effect of the snare carpet 11 is thereby deactivated. If, conversely, the tread 29 is depressed downward, this has the effect that the snare carpet 11 comes to rest against the inside of the front plate 7 and the snare effect is activated.

What is claimed is:

1. A cajon incorporating a snare carpet that rests against the reverse of a front plate, wherein the snare carpet (11) is mounted pivotably so as to be pivoted between an active position and inactive position, wherein the pivotal movement of the snare carpet (11) is actuatable by means of a pedal (28), wherein the pivotal movement of the pedal (28) is transferred via a pivot pin (23) that is supported in a bearing (24), a lever projection (22) fastened thereto, and via a pivot hinge (21) onto an actuation rod (20), and from there via a pivot hinge (18) to an additional lever projection (17) of a pivot arm (14), which supports the snare carpet (11) and wherein the distal end of the lever projection (17) is provided with a pin (18), which engages into a guide groove (19) in the side wall (5).

2. A cajon according to claim 1, wherein the snare carpet (11) is pivotable between a position resting against the inside of the front plate (7) and a pivoted-back position, wherein in the pivoted-back position it rests against a damper strip (9), which extends parallel to the front plate (7) at a distance from the same substantially vertically.

3. A cajon according to claim 1, wherein the pedal (28) is supported pivotably in a side wall (5) of the housing (2).

4. A cajon according to claim 1, wherein the guide groove (19) is formed in a metal plate (15) that is mounted to the side wall (5).

5. A cajon comprising:

a front plate;

a rear plate;

two side walls connecting the front plate to the rear plate to form a rectangular enclosure;

a pivot arm pivotably connected to one of the side walls;

a first lever connected at an inner end of the pivot arm and extending away from the pivot arm;

a snare carpet connected to the pivot arm so as to rest against the front plate, the snare carpet being mounted pivotably on one of the side walls via the pivot arm;

a foot pedal connected to the snare carpet and extending outside of the rectangular enclosure, for actuating pivotal movement of the snare carpet;

a pivot pin connected to the one of the side walls and extending outside of the one side wall, the foot pedal being pivotably fixed to the pivot pin at a midpoint on the foot pedal;

a bearing disposed inside the enclosure, the pivot pin being supported in the bearing;

a second lever fastened to the bearing;

an actuation rod connected at one end to the first lever via a pivot hinge, and to the second lever via the pivot arm;

a guide groove formed in the one of the side walls; and a pin connected to a distal end of the first lever and configured to engage into the guide groove.

6. The cajon according to claim 5, further comprising a damping strip extending between the two side walls parallel to the front plate, wherein the foot pedal comprises two pads, one on each side of the midpoint, and wherein the snare carpet is pivotable between a first position resting against the front plate, and a second position in which the snare carpet rests against the damper strip.

7. A cajon comprising:

a front plate;

a rear plate;

two side walls connecting the front plate to the rear plate to form a rectangular enclosure;

a snare carpet mounted pivotably on one of the side walls so as to rest against the front plate;

a foot pedal connected to the snare carpet and extending outside of the rectangular enclosure, for actuating pivotal movement of the snare carpet;

a pivot pin connected to the one of the side walls and extending outside of the one side wall, the foot pedal being pivotably fixed to the pivot pin at a midpoint on the foot pedal;

an actuation rod operatively connected at one end to the snare carpet, and a second end to the foot pedal so as to transfer pivotal movement of the pedal to the snare carpet.

8. The cajon according to claim 7, further comprising a damping strip extending between the two side walls parallel to the front plate, wherein the foot pedal comprises two pads, one on each side of the midpoint, and wherein the snare carpet is pivotable between a first position resting against the front plate, and a second position in which the snare carpet rests against the damper strip.

9. The cajon according to claim 8, further comprising:

a pivot arm pivotably connected to one of the side walls;

a first lever connected at an inner end of the pivot arm and extending away from the pivot arm, wherein the one end of the actuation rod is connected to the first lever.

10. The cajon according to claim 9, further comprising:

a bearing disposed inside the enclosure, the pivot pin being supported in the bearing;

a second lever fastened to the bearing, wherein the second end of the actuation rod is connected to the second lever.

11. The cajon according to claim 9, further comprising:

a guide groove formed in the one of the side walls; and a pin connected to a distal end of the first lever and configured to engage into the guide groove.

* * * * *